US006018149A

United States Patent [19]

Higgins

[11] Patent Number: 6,018,149

[45] Date of Patent: Jan. 25, 2000

[54] RADIANT ELECTRIC HEATER

[75] Inventor: George Anthony Higgins, Stourbridge, United Kingdom

[73] Assignee: Ceramaspeed Limited, United Kingdom

[21] Appl. No.: 09/211,752

[22] Filed: Dec. 15, 1998

[30] Foreign Application Priority Data

Jan. 16, 1998 [GB] United Kingdom ..... 9800828

[51] Int. Cl.[7] ..... H05B 1/02; H05B 1/00

[52] U.S. Cl. ..... 219/462.1; 219/443.1; 219/457.1; 219/483; 219/460.1; 219/461.1; 219/465.1; 219/466.1; 219/467.1; 219/540

[58] Field of Search ..... 219/443.1, 457.1, 219/460.1, 461.1, 462.1, 465.1, 466.1, 467.1, 483, 484, 485, 486, 487, 539, 540

[56] References Cited

U.S. PATENT DOCUMENTS

| | | | |
|---|---|---|---|
| 4,158,127 | 6/1979 | Husslein . | |
| 4,371,780 | 2/1983 | Gossler et al. | 219/462.1 |
| 4,808,798 | 2/1989 | Goessler et al. | 219/462.1 |
| 5,171,973 | 12/1992 | Higgins | 219/462.1 |
| 5,204,510 | 4/1993 | McWilliams et al. | 219/462.1 |
| 5,270,519 | 12/1993 | Higgins | 219/462.1 |
| 5,498,854 | 3/1996 | McWilliams | 219/462.1 |

FOREIGN PATENT DOCUMENTS

| | | |
|---|---|---|
| 0551172 | 7/1993 | European Pat. Off. . |
| 0571054 | 11/1993 | European Pat. Off. . |
| 2114829 | 8/1983 | United Kingdom . |

*Primary Examiner*—Mark Paschall
*Assistant Examiner*—Fadi H. Dahbour
*Attorney, Agent, or Firm*—Ira S. Dorman

[57] ABSTRACT

A radiant electric heater has first, second and third heating zones (1, 2, 3) arranged substantially side-by-side. The first heating zone (1) is provided with at least one first heating element (9). The second heating zone (2) is arranged adjacent to the first heating zone and is provided with at least one second heating element (10). The third heating zone (3) is arranged adjacent to the second heating zone and is provided with at least one third and one fourth heating element (11, 12). A switch (15) is provided for switching between first, second and third heating states. In the first heating state the at least one first heating element (9) of the first heating zone (1) is energised alone, the at least one second, third and fourth heating elements (10, 11, 12) of the second and third heating zones (2, 3) being de-energised. In the second heating state the at least one first heating element (9) of the first heating zone (1) is electrically connected and energised in parallel with the at least one second heating element (10) of the second heating zone (2), the at least one third and fourth heating elements (11, 12) of the third heating zone (3) being de-energised.

5 Claims, 2 Drawing Sheets

RADIANT ELECTRIC HEATER

This invention relates to a radiant electric heater having multiple heating zones and which may be used, for example, in a cooking appliance having a glass-ceramic cooking plate. More particularly the invention relates to such a heater having three heating zones, which may be concentrically arranged, and particularly, although not exclusively, to such a heater having relatively large overall diameter, for example of the order of 300 mm.

DESCRIPTION OF PRIOR ART

Radiant heaters having multiple, particularly two, concentric heating zones are well known for use in glass-ceramic cooking appliances.

U.S. Pat. No. 4,158,127 describes a range top having a plurality of main cooking stations with an auxiliary cooking station disposed in the vicinity of at least one of the main cooking stations and being conformed to and contiguous with the main cooking station to define a substantially continuous enlarged cooking area. A further auxiliary cooking station may be disposed between adjacent main cooking stations. United Kingdom Patent Publication No. 2,114,829 describes a circuit arrangement for such a range top in which the heating elements or cooking stations are controlled individually.

European Patent Publication No. 0,571,054 describes a radiant electric heater which may incorporate two or three heating elements arranged concentrically to permit selective heating of differently sized areas. Two of the heating elements, in the form of an infrared lamp and a bare wire heating element, may be permanently connected in series to limit lamp inrush current, while a second bare wire heating element may be energised together with the other elements for heating larger size utensils.

Problems have been encountered with such heaters in that it is desirable when heating a small utensil on, for example, an inner heating zone of the heater, for the heating element in such inner zone to be energised with a power level comparable to a single zone heater of similar dimensions. This is in order to ensure rapid heating of the utensil and its contents. However when a larger utensil is being heated, covering both the inner zone and an annular heating zone surrounding the inner zone, then, when the heating element of the outer zone is energised in parallel with the element of the inner zone, the high power of the inner zone results in the surface power loading over the inner zone being greater than that over the outer zone which is disadvantageous. The result of this arrangement is a heater which is centre-weighted in power and it is generally preferred for a heater to be edge-weighted in power.

A further problem is that with large multi-zone heaters, for example of the order of 300mm diameter, provision of heating elements to provide a conventional surface power loading of, for example, about 7 watts per square centimeter results in an electric current level in excess of the handling capabilities of the contacts in standard thermal limiters and energy regulators used in the art.

The first problem is solved in part by European Patent Publication No. 0,551,172 which describes a radiant heater having multiple heating zones in which a heating element, or a combination of a lamp and a coil of bare resistance wire permanently connected in series, is provided in a first, circular heating zone and two heating elements are provided in a second, outer heating zone. The heating power of the first zone may be 1200 watts with a specific surface loading of 0.073 watts per square millimeter, while, when the heating elements in the second zone are also energised with one of the outer heating elements in series with the heating element(s) of the first zone, the specific surface loading of the first zone is reduced to 0.061 watts per square millimeter and the specific surface loading of the second zone is 0.076 watts per square millimeter. Nevertheless, this does not provide a solution where more than two heating zones are present.

OBJECT OF THE INVENTION

It is an object of the present invention to overcome or minimise these problems where three heating zones are present.

SUMMARY OF THE INVENTION

The present invention provides a radiant electric heater having multiple heating zones arranged substantially side-by-side and comprising:

a first heating zone provided with at least one first heating element; a second heating zone arranged adjacent to the first heating zone and provided with at least one second heating element; a third heating zone arranged adjacent to the second heating zone and provided with at least one third and one fourth heating element; and switch means for switching between first, second and third heating states; the arrangement of the switch means being such that in the first heating state the at least one first heating element of the first heating zone is energised alone, the at least one second, third and fourth heating elements of the second and third heating zones being de-energised; and that in the second heating state the at least one first heating element of the first heating zone is electrically connected and energised in parallel with the at least one second heating element of the second heating zone, the at least one third and fourth heating elements of the third heating zone being de-energised; and that in the third heating state the at least one first heating element of the first heating zone is electrically connected in parallel with the at least one second heating element of the second heating zone and the parallel-connected at least one first and at least one second heating elements are connected in series with the at least one third heating element of the third heating zone to form a combination, which combination is electrically connected in parallel with the at least one fourth heating element of the third heating zone and energised therewith.

The first, second and third heating zones may be separated by walls of thermal insulating material.

The first heating zone may be circular and the second and third heating zones may be annular, the second heating zone surrounding the first heating zone and the third heating zone surrounding the second heating zone.

The heating elements of the first, second and third heating zones may comprise any of the known forms, such as wire, ribbon or lamp forms, or combinations thereof.

By means of the invention, the heating elements of the first and second heating zones, when the heater is energised in the first and second heating states, provide relatively high surface power loading (for example about 6 to 7 watts per square centimeter) over the first and second heating zones. However, when the heater is energised in the third heating state, the surface power loading over the first and second heating zones is reduced, for example to about 4 to 5 watts per square centimeter, while the surface power loading over the third heating zone is high relative thereto at, for example, about 6 watts per square centimeter. Advantageous edge-weighting of power is thereby achieved when all three heating zones are energised, whilst an advantageously high surface power loading is achieved over the first and second heating zones when these are energised without the third heating zone.

Furthermore the total power of the heater can be maintained at such a level, for example 2700 watts, that excessively high currents are avoided.

The invention is now described by way of example with reference to the accompanying drawings, in which:

DESCRIPTION OF PREFERRED EMBODIMENT

Figure 1:
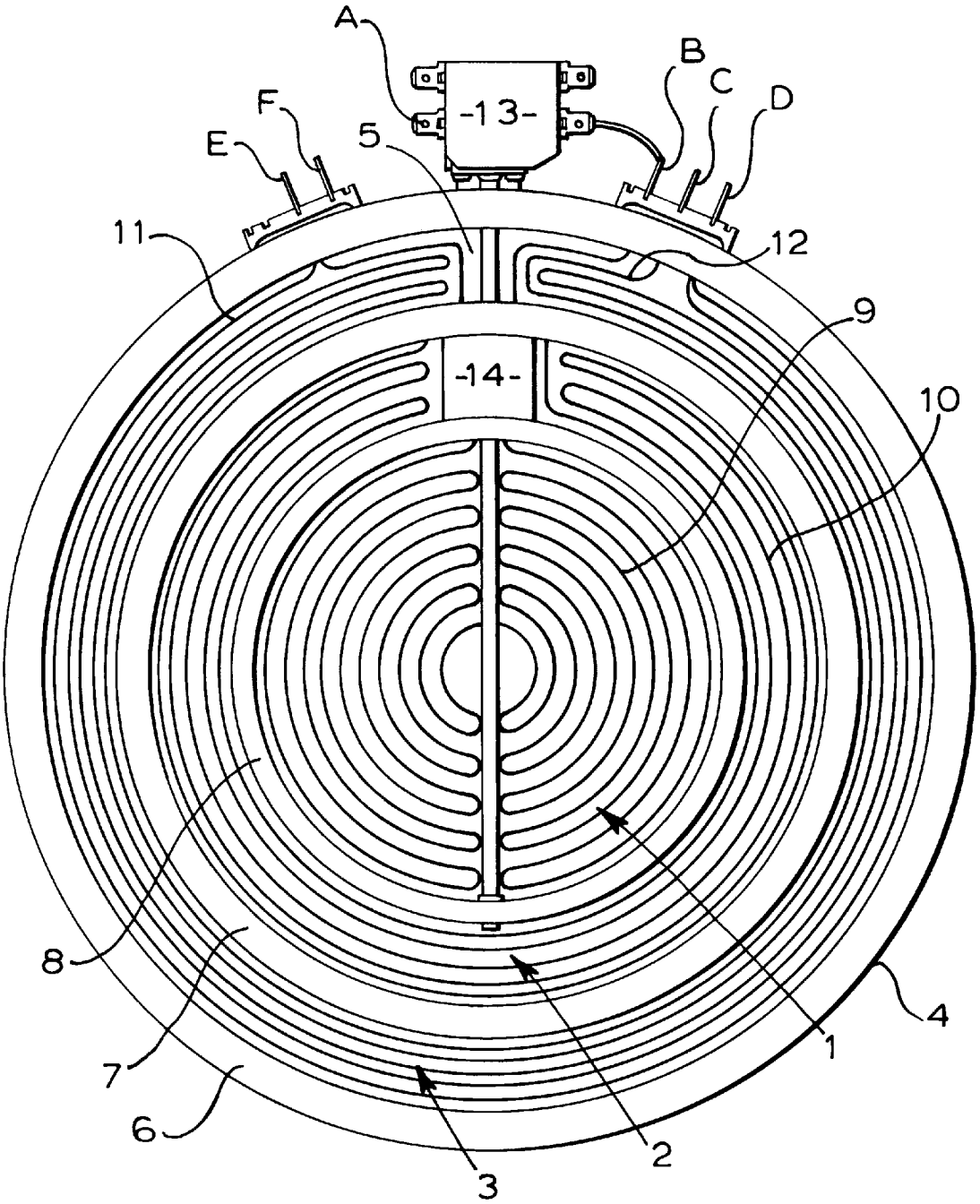
FIG. 1 is a plan view of one embodiment of a radiant electric heater according to the invention.
Figure 2:
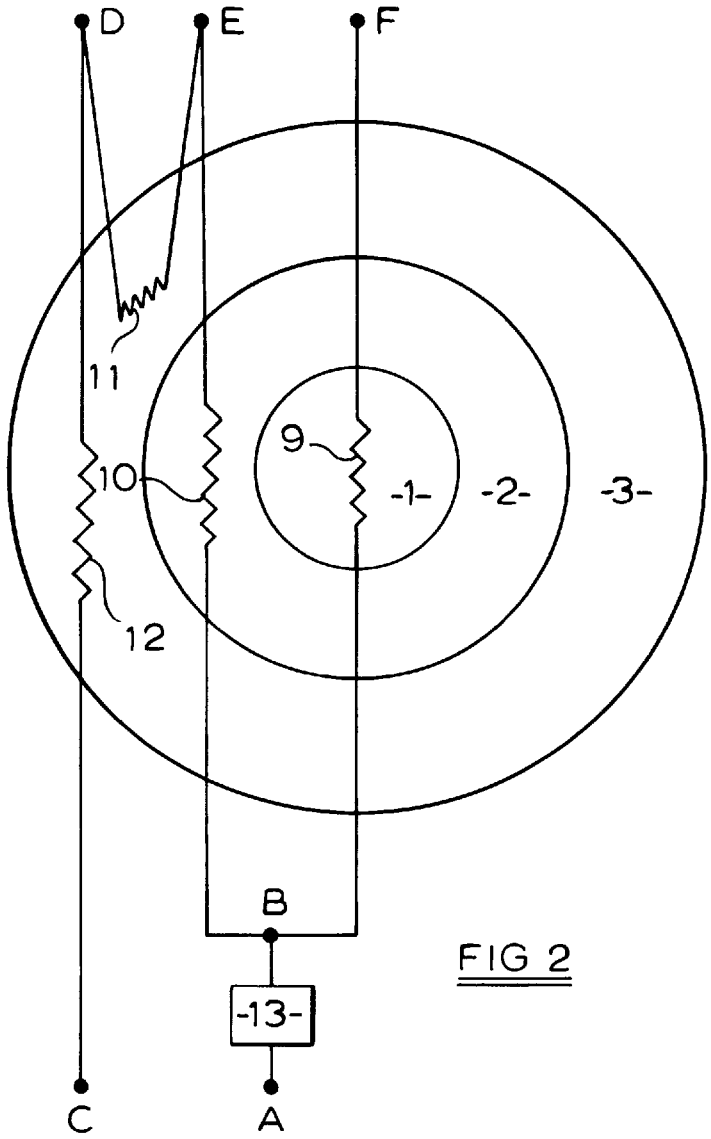
FIG. 2 is a schematic representation of the connection of heating elements in the heater of FIG. 1.

A radiant electric heater is constructed having three concentric heating zones 1, 2, 3. A circular first heating zone 1 is surrounded by an annular second heating zone 2 which is in turn surrounded by an annular third heating zone 3.

The three heating zones are formed as follows. A metal supporting dish 4 has provided therein a base layer 5 of insulation material, such as well known microporous thermal and electrical insulation material. A peripheral wall 6 of insulation material of well known form is provided around the edge of the dish and two further annular walls 7, 8 of similar form are provided in the dish to define the heating zones 1, 2 and 3. The heater is intended for use in a glass-ceramic cooking appliance with at least the peripheral wall 6 in contact with the underside of a glass-ceramic cooking surface (not shown).

A first heating element 9, which may be of ribbon form although any other forms could be considered, is provided in the first heating zone 1.

A second heating element 10, of the same form as, or different from, the first heating element 9, is provided in the second heating zone 2.

A third heating element 11 and a fourth heating element 12 are provided in the third heating zone 3 and may be of the same form as, or different from, the first and second heating elements 9 and 10.

By way of example, the first heating zone may have a diameter of about 145 mm, the first and second heating zones together may have a diameter of about 210 mm and the first, second and third heating zones together may have a diameter of about 275 mm.

A well-known form of thermal limiter 13 is provided having a sensor rod thereof extending at least partly across the heater. As shown in FIG. 1, the sensor rod of the limiter 13 is shielded by a block 14 of thermal insulation material from the influence of the second heating element 10 in the second heating zone 2, but this is not essential.

Figure 3:
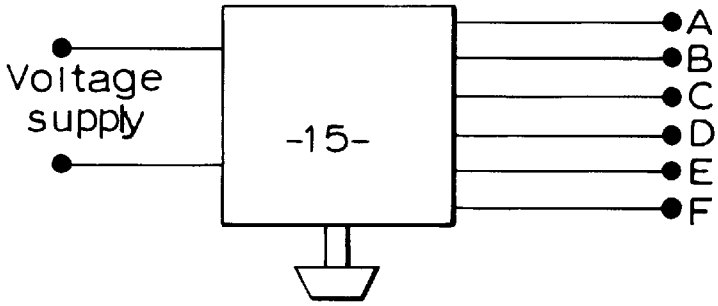
FIG. 3 is a schematic representation of a known form of switch for connecting the heater to a voltage supply.

As shown in FIG. 3, the heater is arranged to be energised from a voltage supply, such as a 230 volts supply, by way of a well known form of switch (15) arranged to connect the heater in three heating states as follows.

In a first heating state, the first heating element 9 in the first heating zone 1 is energised alone by connecting terminals A and F to the supply. By way of example, this results in a power dissipation of about 1050 watts in the first heating element 9 and a surface power loading over the first heating zone 1 of about 6.4 watts per square centimeter.

In a second heating state, the first heating element 9 in the first heating zone 1 remains energised as before, while the second heating element 10 in the second heating zone 2 is energised in parallel therewith by connecting terminals A and E to the supply. By way of example, this results in a power dissipation of about 1150 watts in the second heating element and a surface power loading over the second heating zone 2 of about 7.6 watts per square centimeter. A cooking utensil located over the first and/or second heating zones 1, 2 will be heated rapidly and efficiently as a result of the relatively high surface power loadings over these heating zones.

In a third heating state, the first heating element 9 in the first heating zone 1 is electrically connected in parallel with the second heating element 10 in the second heating zone 2 and this parallel arrangement of elements 9 and 10 is connected in series with the third heating element 11 in the third heating zone 3 to form a resultant combination of elements 9, 10 and 11, which combination is electrically connected in parallel with the fourth heating element 12 in the third heating zone 3 and energised therewith. For this purpose, the voltage supply is connected to terminals A and D while terminal E is connected to terminal F and terminal B is connected to terminal C.

Again by way of example, this results in a power dissipation of about 300 watts in the third heating element 11 and about 900 watts in the fourth heating element 12, in the third heating zone. This provides a surface power loading of about 5.6 watts per square centimeter over the third heating zone. However, in this heating state the power dissipated in the parallel combination of the first and second heating elements 9, 10 reduces to about 1500 watts, compared with a value of about 2200 watts in the second heating state, the total heater power being about 2700 watts. This provides a surface power loading of about 5.0 watts per square centimeter over the second heating zone 2 and about 4.4 watts per square centimeter over the first heating zone 1. In this heating state the heater is edge-weighted in power and this, together with the associated reductions in surface power loadings, is particularly advantageous for simmering operations using large cooking utensils.

Since the total heater power in the third heating state is about 2700 watts, the resulting current of about 12 amps is well within the handling capacity of the thermal limiter contacts, the switch contacts and any associated energy regulator, where provided.

I claim:

1. A radiant electric heater having multiple heating zones arranged substantially side-by-side and comprising:

a first heating zone provided with at least one first heating element; a second heating zone arranged adjacent to the first heating zone and provided with at least one second heating element; a third heating zone arranged adjacent to the second heating zone and provided with at least one third and one fourth heating element; and switch means for switching between first, second and third heating states; the arrangement of the switch means being such that in the first heating state the at least one first heating element of the first heating zone is energized alone, the at least one second, third and fourth heating elements of the second and third heating zones being de-energized; and that in the second heating state the at least one first heating element of the first heating zone is electrically connected and energized in parallel with the at least one second heating element of the second heating zone, the at least one third and fourth heating elements of the third heating zone being de-energized; and that in the third heating state the at least one first heating element of the first heating zone is electrically connected in parallel with the at least one second heating element of the second heating zone and the parallel-connected at least one first and at least one second heating elements are connected in series with the at least one third heating element of the third heating zone to form a combination, which combination is electrically connected in parallel with the at least one fourth heating element of the third heating zone and energized therewith.

2. A heater according to claim 1, wherein the first, second and third heating zones are separated by walls of thermal insulating material.

3. A heater according to claim 1, wherein the first heating zone is circular and the second and third heating zones are annular, the second heating zone surrounding the first heating zone and the third heating zone surrounding the second heating zone.

4. A heater according to claim 1, wherein the heating elements are selected from wire, ribbon and lamp forms and combinations thereof.

5. A cooking appliance provided with a radiant electric heater according to claim 1.

* * * * *